US005101087A

United States Patent [19]

Brotz

[11] Patent Number: 5,101,087

[45] Date of Patent: Mar. 31, 1992

[54] HIGH-TEMPERATURE ROLLERS UTILIZING FLUIDIZED BED

[76] Inventor: Gregory R. Brotz, P.O. Box 1322, Sheboygan, Wis. 53081

[21] Appl. No.: 437,072

[22] Filed: Nov. 15, 1989

[51] Int. Cl.[5] ..... H05B 6/14

[52] U.S. Cl. ..... 219/10.492; 219/10.61 R; 219/463; 219/469; 219/471; 165/89; 100/93 RP; 404/95; 404/122

[58] Field of Search ..... 219/10.492, 10.61, 469, 219/471, 463, 406; 126/410, 270, 438; 165/89; 100/93 RP; 404/95, 122

[56] References Cited

U.S. PATENT DOCUMENTS

| | | | |
|---|---|---|---|
| 82,009 | 9/1868 | Kittredge | 404/95 |
| 524,939 | 8/1894 | Dennison | 404/95 |
| 1,628,554 | 5/1927 | Pagano | 219/463 |
| 2,739,218 | 3/1956 | Wennerlund | 219/469 |
| 3,331,434 | 7/1967 | Lockhart | 165/89 |
| 3,401,626 | 9/1968 | Amalfitano | 219/469 |
| 3,423,573 | 1/1969 | Richards et al. | 219/469 |
| 3,720,808 | 3/1973 | Morrissey | 219/469 |
| 3,993,458 | 11/1976 | Antal | 126/270 |
| 4,097,711 | 6/1978 | Banerjee | 219/76.15 |
| 4,290,779 | 9/1981 | Qader | 126/438 |
| 4,350,861 | 9/1982 | Pouillange et al. | 219/10.61 A |
| 4,906,441 | 3/1990 | Flagella | 219/406 |
| 4,931,794 | 6/1990 | Haag et al. | 341/31 |

*Primary Examiner*—Bruce A. Reynolds
*Assistant Examiner*—Tu Hoang
*Attorney, Agent, or Firm*—William Nitkin

[57] ABSTRACT

A mill roll having a pair of ceramic, hollow rollers with the chambers defined in each filled with a plurality of particles with spaces defined therebetween including means to enter fuel therein to be burned to heat the rollers to incandescent temperatures.

1 Claim, 1 Drawing Sheet

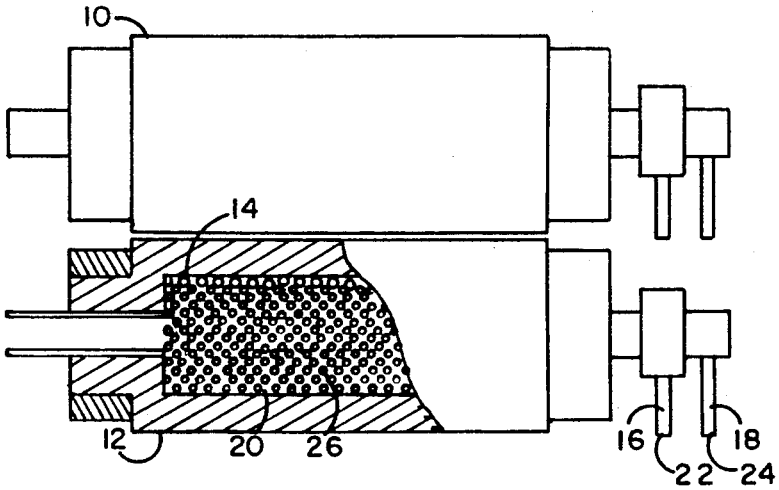
FIG. 1
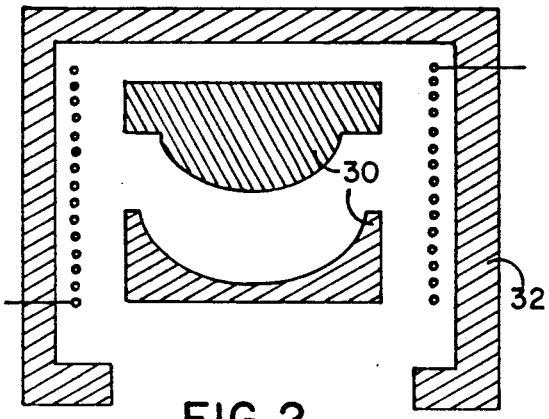
FIG. 2
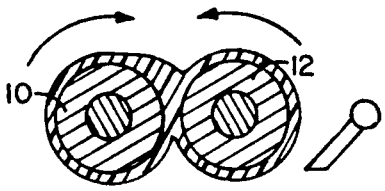
FIG. 3
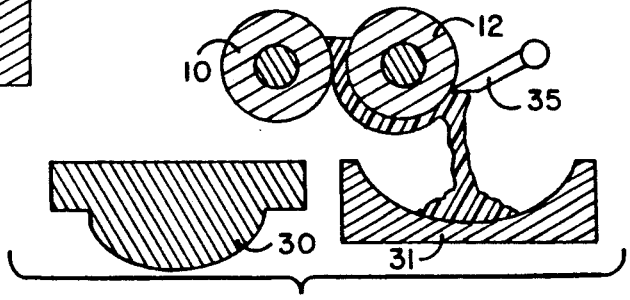
FIG. 4
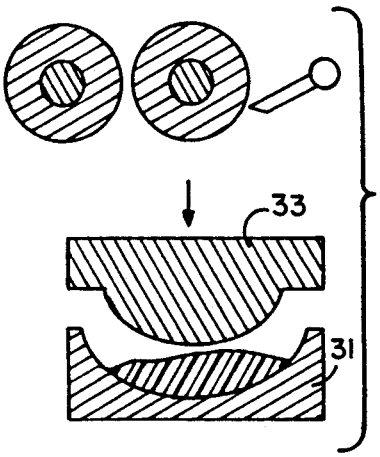
FIG. 5
FIG. 6
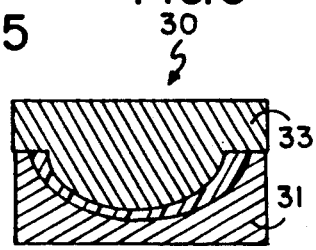
FIG. 7
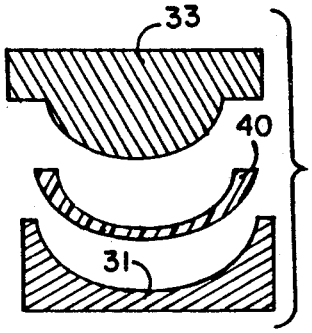

HIGH-TEMPERATURE ROLLERS UTILIZING FLUIDIZED BED

BACKGROUND OF THE INVENTION

1. Field of the Invention

The structure of this invention resides in the area of heated rollers and more particularly relates to a high-temperature roll for the melting and shearing of product and to certain materials which can be produced on the rollers of such roll.

2. Description of the Prior Art

Conventional roll mills are well known in the art for mixing amounts of materials which are delivered into the nip of the rollers. Many of such roll mills are heated, for example, to melt resins to form a mixture and to blend such mass of materials forming a sheet around the rollers with a buildup of materials forming over the nip where great forces shear the materials together to form an homogenous mass. This type of mixing is highly desirable and is often superior to other forms of material mixing. Sheets that come off such rollers can be cut with a knife or directly deposited into molds.

Heated rollers are disclosed in U.S. Pat. No. 3,331,434 to Lockhart and U.S. Pat. No. 524,939 to Dennison and U.S. Pat. No. 82,009 to Kitteridge. Also, U.S. Pat. No. 4,931,794 to Riihinen shows a roll heated by electrical induction heating for use as a roll in the production of paper as a calendar roll and drying cylinder.

SUMMARY OF THE INVENTION

It is an object of this invention to provide refractory rollers which heat to extremely high temperatures the material being sheared and mixed therebetween. In one embodiment a pair of hollow rollers each contains carbide particles forming a bed inside the hollow rollers in which combustion can occur with means to enter fuel and air therein to be mixed and burned inside each roller to achieve high temperatures on the surface of each roller. In a further embodiment such rollers can also be heated with an electrical induction coil contained in the carbon particle bed. It is important to this invention that high melting temperatures be achieved in such rollers as many of the compounds being mixed are glasses or other compounds which require high temperatures in order to maintain such materials in a melted state for combination with other compounds at such high temperatures.

BRIEF DESCRIPTION OF THE DRAWINGS

FIG. 1 illustrates a top plan view of the refractory rollers of this invention with a section cut away from one of the rollers.

FIG. 2 illustrates the heating of a mold to receive product produced by the roll of this invention.

FIG. 3 illustrates a cross-sectional end view of materials being blended on the roll of this invention.

FIG. 4 illustrates an end view of materials being blended on a roller of this invention and delivered to a mold.

FIG. 5 illustrates a cross-section of the mold with liquid material to be molded therein.

FIG. 6 illustrates a cross-section of the mold closed and cooled.

FIG. 7 illustrates a cross-section of the mold opened with formed product removed therefrom.

DESCRIPTION OF THE PREFERRED EMBODIMENT(S)

FIG. 1 illustrates a top plan view of the refractory roll of this invention showing first roller 10 and second roller 12. The first and second rollers can be made of a thick wall of ceramic material. Each roller contains therein a chamber 14 and in one embodiment has a plurality of carbide particles 20 filling the chamber with spaces defined between particles to help promote uniform heating when fuel 22 and air 24 are entered through tubes 16 and 18 into fluid bed 26 for ignition therein so that rollers 10 and 12 can reach the high temperatures of incandescence being approximately 1200 degrees F. sufficient to shear and melt the materials being mixed thereon. In an alternate embodiment electric induction coils can be placed in the carbide particle bed within the rollers to heat them to the necessary high temperatures.

One process that can be performed on such rollers to produce a useful compound is to heat melamine in a furnace during which ammonia is released, leaving a melem and melon which is a condensed ring structure containing nitrogen, carbon and hydrogen according to the following atomic arrangement:

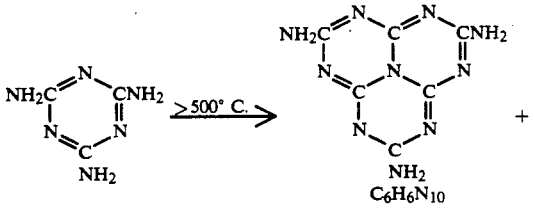

$$NH_3 \xrightarrow{>600^\circ C.} C_6H_9N_{11} + NH_3 \quad \text{(structure)}$$

If the melem/melon is mixed with a molten silicate glass or other high-temperature melting compound that can be used as a binder, it will produce a useful compound for producing various electrical or structural members. This resulting mixture of melem or melon with a high-temperature material suitable as a matrix to act as a binder is also useful as a filler additive or microreinforcing structure in any high-melting temperature material. Such high-temperature material can be of silicate, glass, metal oxides and equivalent materials. Binders that could be utilized are as follows:

| Compound | | Melting Point |
|---|---|---|
| Vycor (96% sio) | | 1550 |
| Fused silica | | 1710 |
| CaF | | 1330 |
| Feo | | 1560 |
| SiO | Approx. demarcation of material | 1710 |
| AlO | being rolled and material con- | 2050 |
| ZrO | stituting the roll | 2700 |
| MgO | | 2800 |
| TiC | | 3190 |
| Graphite | | 3500 |

FIG. 2 illustrates the first step in a process where materials which have been blended and rolled on the high-temperature roll of this invention can be molded. Seen in this view is the pre-heating of mold 30 within oven 32. End views of rollers 10 and 12 are seen in FIG.

3 with the materials being blended and direction of movement therearound. In FIG. 4 the mold is seen with its bottom open with an arm 35 catching the blended materials off one of the rollers and directing it into bottom 31 of the mold which, once it is therein as seen in FIG. 5, top 33 of the mold is placed thereover and mold 30 in FIG. 6 is cooled and top 33 and bottom 31 are then separated as seen in FIG. 7 with the product 40 removed therefrom. It should be noted that other products could also be made within the heated rollers of this invention such as molten glass with triazine graphite in a mixture and aluminum-rich glass which contains a high percentage of aluminum to reduce its brittleness. These glasses also can contain iron and serrium within their alloys as well as in some cases nickel and yttrium. Such aluminum-rich glass which can be mixed in this type of high-temperature roll rather than melt-spinning is useful as a lightweight construction material in the aerospace field because they crystallize at a relatively high temperature.

Although the present invention has been described with reference to particular embodiments, it will be apparent to those skilled in the art that variations and modifications can be substituted therefor without departing from the principles and spirit of the invention.

I claim:

1. A mill roll comprising:

a pair of ceramic rollers having thick walls and exterior faces with a hollow chamber defined in each of said rollers, each of said chambers forming a fluid bed;

a plurality of particles filling said chambers having spaces defined between said particles, said particles selected from the group consisting of carbides, refractory and high-temperature melting metals and metal oxides; and means to heat said rollers to an incandescent temperature of approximately 1200 degrees F., said means to heat said rollers including means to enter fuel, which is air and gas, when burned in said fluid beds to heat the exterior faces of said rollers to incandescent temperatures.

* * * * *